US010633613B2

(12) United States Patent
Burgess et al.

(10) Patent No.: US 10,633,613 B2
(45) **Date of Patent: *Apr. 28, 2020**

(54) FABRIC TREATMENT COMPOSITION COMPRISING PEG AND AN ANIONIC AND/OR CATIONIC SILICONE

(71) Applicant: Conopco, Inc., Englewood Cliffs, NJ (US)

(72) Inventors: Karl Burgess, Wirral (GB); Martin Charles Crossman, Eastham (GB); Peter Graham, Upton (GB); Jonathan Osler, Wirral (GB); Hugh Rieley, Wirral (GB); Shaun Charles Walsh, Cheadle (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/526,974

(22) PCT Filed: Nov. 6, 2015

(86) PCT No.: PCT/EP2015/075996

§ 371 (c)(1),
(2) Date: May 15, 2017

(87) PCT Pub. No.: WO2016/078942

PCT Pub. Date: May 26, 2016

(65) Prior Publication Data

US 2017/0327772 A1 Nov. 16, 2017

(30) Foreign Application Priority Data

Nov. 17, 2014 (EP) ..... 14193487

(51) Int. Cl.

| | |
|---|---|
| ***C11D 9/36*** | (2006.01) |
| ***C11D 3/00*** | (2006.01) |
| ***C11D 3/37*** | (2006.01) |
| ***C11D 3/22*** | (2006.01) |
| ***C11D 1/62*** | (2006.01) |

(52) U.S. Cl.
CPC ..... *C11D 3/001* (2013.01); *C11D 1/62* (2013.01); *C11D 3/227* (2013.01); *C11D 3/373* (2013.01); *C11D 3/3707* (2013.01); *C11D 3/3742* (2013.01)

(58) Field of Classification Search
CPC ..... C11D 9/36
See application file for complete search history.

(56) References Cited

U.S. PATENT DOCUMENTS

| | | | | |
|---|---|---|---|---|
| 2007/0105739 | A1* | 5/2007 | Wahl | C11D 3/0015 510/295 |
| 2009/0042766 | A1 | 2/2009 | Mayer et al. | |
| 2013/0267454 | A1 | 10/2013 | Aouad | |

FOREIGN PATENT DOCUMENTS

| | | | |
|---|---|---|---|
| EP | 1561803 | | 8/2005 |
| WO | 2005/090538 | A2 | 9/2005 |
| WO | WO2006132872 | | 12/2006 |
| WO | 2008/009521 | A1 | 1/2008 |
| WO | 2008009521 | * | 1/2008 |
| WO | WO2008009521 | | 1/2008 |
| WO | 2014/079621 | A1 | 5/2014 |
| WO | WO2014099879 | | 6/2014 |

OTHER PUBLICATIONS

IPRP2 in PCTEP2015075996, Feb. 17, 2017.
Search Report & Written Opinion in PCTEP2015075994, dated Jan. 25, 2016.
Search Report & Written Opinion in PCTEP2015075996, dated Jan. 25, 2016.
Search Report and Written Opinion in EP14193485, dated May 15, 2015.
Search Report and Written Opinion in EP14193487, dated May 11, 2015.
Written Opinion 2 in PCTEP2015075996, Oct. 7, 2016.
Co-Pending Application; Applicant: Burgess et al., filed: May 15, 2017.
Izunobi et al., "Polymer Molecular Weight Analysis by H NMR Spectroscopy", Journal of Chemical Education, May 31, 2011, 88, 1098-1104.
Dong Yongchun; Chemistry of Textile Auxiliaries, edited by Dong Yongchun, Shanghai: Donghua University Press, Dec. 2009, pp. 197 and 201.; Chemistry of Textile Auxiliaries, edited by Dong Yongchun, Shanghai: Donghua University Press, Dec. 2009, pp. 197 and 201.; Dec. 2009; pp. 197 and 201; Shanghai: Donghua University Press.

* cited by examiner

*Primary Examiner* — Charles I Boyer
(74) *Attorney, Agent, or Firm* — Greenberg Traurig, LLP

(57) ABSTRACT

The invention relates to a fabric treatment composition comprising: a) from 60 to 99 wt. % of polyethylene glycol; b) from 0.1 to 5 wt. % of cationic polymer; and, c) from 0.1 to 10 wt. % of silicone.

12 Claims, No Drawings

FABRIC TREATMENT COMPOSITION COMPRISING PEG AND AN ANIONIC AND/OR CATIONIC SILICONE

FIELD OF THE INVENTION

The invention relates to a fabric treatment composition including a silicone that displays improved softening.

BACKGROUND OF THE INVENTION

Silicone is a useful ingredient in fabric treatment compositions for the provision of softness to fabrics.

SUMMARY OF THE INVENTION

There is a problem that the softening performance of the silicone can be improved.

It is an object of the invention to improve the softening performance of a silicone during the laundry process.

We have now found that if instead of addition as part of the laundry detergent, the silicone is provided as part of a separate composition, then the softening performance is improved.

The invention therefore provides in a first aspect of the invention, a fabric treatment composition comprising:

a) from 60 to 99 wt. % of polyethylene glycol;

b) from 0.1 to 5 wt. % of cationic polymer; and, c) from 0.1 to 10 wt. % of silicone.

Preferably the polyethylene glycol is present at a level of from 62 to 98 wt. %, more preferably from 64 to 95 wt. %. Preferably the polyethylene glycol has a molecular weight of from 2,000 to 20,000, more preferably from 3,000 to 12,000, most preferably from 6,000 to 10,000.

Preferably the cationic polymer is present at a level of from 0.1 to 4 wt. %, more preferably from 0.1 to 3 wt. %, even more preferably from 0.25 to 2.5 wt. %, most preferably from 0.25 to 1.5 wt. %. Preferably the cationic polymer is a cationic polysaccharide polymer, more preferably a cationic cellulose polymer or a cationic guar polymer, most preferably a cationic cellulose polymer.

Preferably the silicone is present at a level of from 0.25 to 8 wt. %, more preferably from 0.25 to 6 wt. %, even more preferably from 0.5 to 4 wt. %, most preferably from 0.5 to 3 wt. %. Preferably the silicone is selected from: PDMS; silicone polyethers; quaternary, cationic or aminosilicones; and, anionic silicones such as silicones that incorporate a carboxylic, sulphate, sulphonic, phosphate and/or phosphonate functionality. Preferably the silicone is an anionic silicone, preferably a carboxyl functionalised silicone.

Optionally there is a secondary carrier other than polyethylene glycol. The secondary carrier may be present at a level of from 5 to 45 wt. %, preferably from 5 to 40 wt. %, more preferably from 7.5 to 35 wt. %. If present, then preferably the secondary carrier is starch. If present, then preferably the starch is present at a level of from 5 to 45 wt. %, more preferably from 5 to 40 wt. %, most preferably from 7.5 to 35 wt. %, for example 7.5 to 30 wt. % or even 7.5 to 27.5 wt. %.

Preferably the composition comprises perfume at a level of from 1 to 15 wt. %, preferably from 1 to 12 wt. %, more preferably from 1.5 to 10 wt. %. Preferably the perfume comprises free perfume oil and perfume encapsulates.

Preferably the composition is in the form of a pastille. Preferably the pastille has a shape that is circular, spherical, oval, or lozenge shape. More preferably the shape is circular with a flat base. Preferably each pastille has a mass of from 0.05 mg to 2 g.

Preferably the composition further comprises one or more of the following ingredients: shading dye, enzyme, antiredeposition polymer, dye transfer inhibiting polymer, soil release polymer, sequestrant, and/or fluorescent agent.

DETAILED DESCRIPTION OF THE INVENTION

Polyethylene Glycol (PEG)

The fabric treatment composition comprises from 60 to 99 wt. % of polyethylene glycol. A preferred level of PEG is from 62 to 98 wt. %, more preferably from 64 to 95 wt. %.

PEG is the polymer of ethylene oxide. The PEG polymer can be made in a variety of different molecular weights. Suitable molecular weight ranges are from 2,000 to 20,000, more preferably from 3,000 to 12,000, most preferably from 6,000 to 10,000.

Cationic Polymer

The composition comprises a cationic polymer at a level of from 0.1 to 5 wt. %, preferably from 0.1 to 4 wt. %, more preferably from 0.1 to 3 wt. %, even more preferably from 0.25 to 2.5 wt. %, most preferably from 0.25 to 1.5 wt. %.

This term refers to polymers having an overall positive charge.

Preferably the cationic polymer is selected from the group consisting of: cationic polysaccharide polymers, and cationic non-saccharide polymers having cationic protonated amine or quaternary ammonium functionalities that are homo or copolymers derived from monomers containing an amino or quaternary nitrogen functional group polymerised from at least one of the following monomer classes: acrylate, methacrylate, acrylamide, methacrylamide; allyls (including diallyl and methallyl); ethylene imine; and/or vinyl monomer classes, and mixtures thereof.

Most preferably the cationic polymer is a cationic polysaccharide polymer.

More preferably the cationic polysaccharide polymer is a cationic guar or cationic cellulose polymer. Most preferably the cationic polymer is a cationic cellulose polymer, for example, quaternised hydroxy ethyl cellulose.

The composition may include a single cationic polymer or a mixture of cationic polymers from the same or different classes, i.e. the composition may contain a cationic polysaccharide polymer and a cationic non-polysaccharide polymer. Suitable commercial cationic non-polysaccharide polymers are ones preferably but not exclusively taken from the Polyquarternium series for example Polyquat 5, 6, 7, 11, 15, 16, 28, 32, 37 and 46 which are sold commercially under the Flocare, Merquat, Salcare, Mirapol, Gafquat and Luviquat tradenames. Cationic non-polysaccharides can be used without conforming to the Polyquaterium nomenclature.

A preferred class of cationic polysaccharide polymers suitable for this invention are those that have a polysaccharide backbone modified to incorporate a quaternary ammonium salt. Preferably the quaternary ammonium salt is linked to the polysaccharide backbone by a hydroxyethyl or hydroxypropyl group. Preferably the charged nitrogen of the quaternary ammonium salt has one or more alkyl group substituents.

Preferred cationic polysaccharide-based polymers have a guar based, or cellulosic based backbone. Cellulose based cationic polymers are most preferred.

Guar is a galactomannan having a β-1,4 linked mannose backbone with branchpoints to α-1,6 linked galactose units.

Suitable cationic guar gum derivatives, such as guar hydroxypropyltrimonium chloride, specific examples of which include the Jaguar series commercially available from Rhone-Poulenc Incorporated and the N-Hance series commercially available from Aqualon Division of Hercules, Inc.

An example of a preferred guar based cationic polymer is guar 2-hydroxy-3-(trimethylammonium) propyl ether salt.

Cellulose is a polysaccharide with glucose as its monomer, specifically it is a straight chain polymer of D-glucopyranose units linked via β-1,4 glycosidic bonds and is a linear, non-branched polymer.

Example cationic cellulose polymers are salts of hydroxyethyl cellulose reacted with trimethyl ammonium substituted epoxide, referred to in the field under the International Nomenclature for Cosmetic Ingredients as Polyquaternium 10 and is commercially available from The Dow Chemical Company, marketed as the UCARE LR and JR series of polymers. Other polymers are marketed under the SoftCAT tradename from The Dow Chemical Company. Other suitable types of cationic celluloses include the polymeric quaternary ammonium salts of hydroxyethyl cellulose reacted with lauryl dimethyl ammonium-substituted epoxide referred to in the field under the International Nomenclature for Cosmetic Ingredients as Polyquaternium 24.

Typical examples of preferred cationic cellulosic polymers include cocodimethylammonium hydroxypropyl oxyethyl cellulose, lauryldimethylammonium hydroxypropyl oxyethyl cellulose, stearyldimethylammonium hydroxypropyl oxyethyl cellulose, and stearyldimethylammonium hydroxyethyl cellulose; cellulose 2-hydroxyethyl 2-hydroxy 3-(trimethyl ammonio) propyl ether salt, polyquaternium-4, polyquaternium-10, polyquaternium-24 and polyquaternium-67 or mixtures thereof.

More preferably the cationic cellulosic polymer is a quaternised hydroxy ether cellulose cationic polymer. These are commonly known as polyquaternium-10. Suitable commercial cationic cellulosic polymer products for use according to the present invention are marketed by The Dow Chemical Corporation under the trade name UCARE.

The counterion of the cationic polymer is freely chosen from the halides: chloride, bromide, and iodide; or from hydroxide, phosphate, sulphate, hydrosulphate, ethyl sulphate, methyl sulphate, formate, and acetate.

Many of the aforementioned cationic polymers can be synthesised in, and are commercially available in, a number of different molecular weights. Preferably the molecular weight of the cationic polymer is from 10,000 to 2,000,000 Daltons, more preferably from 100,000 to 1,000,000 Daltons, even more preferably from 250,000 to 1,000,000 Daltons.

Silicone

The composition comprises fabric softening silicone at a level of from 0.1 to 10 wt. %, preferably from 0.25 to 8 wt. %, more preferably from 0.25 to 6 wt. %, even more preferably from 0.5 to 4 wt. %, most preferably from 0.5 to 3 wt. %.

The silicone is preferably selected from: PDMS; silicone polyether, quaternary, cationic or aminosilicones; and, anionic silicones such as silicones that incorporate a carboxylic, sulphate, sulphonic, phosphate and/or phosphonate functionality.

A preferred silicone is an aminosilicone or an anionic silicone. The most preferred is an anionic silicone.

The amino silicone may be present in the form of the amine or the cation.

Examples of amino silicones are amino functional silicones with a nitrogen content of between 0.1 and 0.8%.

Preferably the amino silicone has a molecular weight of from 1,000 to 100,000, more preferably from 2,000 to 50,000 even more preferably from 5,000 to 50,000.

Examples of anionic silicones are silicones that incorporate carboxylic, sulphate, sulphonic, phosphate and/or phosphonate functionality. Preferred anionic silicones are carboxyl functionalised silicones.

The anionic silicone may be in the form of the acid or the anion. For example for the carboxyl functionalised silicone, it may be present as a carboxylic acid or carboxylate anion.

Preferably the anionic silicone has a molecular weight of from 1,000 to 100,000, more preferably from 2,000 to 50,000 even more preferably from 5,000 to 50,000, most preferably from 10,000 to 50,000.

Preferably the anionic silicone has an anionic group content of at least 1 mol %, preferably 2 mol %.

Form of the Fabric Treatment Composition

The fabric treatment may be shaped into any suitable form. It may take the form of sheets, or preferably be formed into a pastille.

The pastille composition is melted then maintained at a temperature of 60° C.+/−10° C., then pumped onto a perforated cylinder which is perforated in the desired shape of the final product. The melt is then delivered to a chilled steel belt to rapidly cool and solidify the pastille.

The pastille can be processed into any desirable shape, including circular shapes, spheres, ovals, lozenges and the like. Preferably the shape is circular with a flat base.

A preferred mass of a pastille is from 0.05 mg to 2 g.

Optional Ingredients

Perfume

The composition may preferably comprise from 0.1 to 15 wt. % of perfume. Preferably the composition comprises from 1 to 12 wt. % of perfume, more preferably from 1.5 to 10 wt. % of perfume.

Many suitable examples of perfumes are provided in the CTFA (Cosmetic, Toiletry and Fragrance Association) 1992 International Buyers Guide, published by CFTA Publications and OPD 1993 Chemicals Buyers Directory 80th Annual Edition, published by Schnell Publishing Co.

The perfume may be in the form of free perfume oil, perfume encapsulates or a mixture thereof.

Other Carrier Materials

The composition may additionally comprise, in addition to the polyethylene glycol, a secondary carrier material.

The secondary carrier may be present at a level of from 5 to 45 wt. %, preferably from 5 to 40 wt. %, more preferably from 7.5 to 35 wt. %. If present, then preferably the secondary carrier is starch. If present, then preferably the starch is present at a level of from 5 to 45 wt. %, more preferably from 5 to 40 wt. %, most preferably from 7.5 to 35 wt. %, for example 7.5 to 30 wt. % or even 7.5 to 27.5 wt. %.

Starch is a carbohydrate. The starch may be modified or refined. A preferred type of starch is tapioca starch.

Further Ingredients

The laundry treatment composition may further optionally comprise one or more of the following optional ingredients, shading dye, enzyme, antiredeposition polymer, dye transfer inhibiting polymer, soil release polymer, sequestrant, and/or fluorescent agent.

Shading Dye

Shading dyes deposit to fabric during the wash or rinse step of the washing process providing a visible hue to the fabric. Shading of white garments may be done with any colour depending on consumer preference. Blue and Violet are particularly preferred shades and consequently preferred dyes or mixtures of dyes are ones that give a blue or violet shade on white fabrics. The shading dyes used are preferably blue or violet.

The shading dye chromophore is preferably selected from the group comprising: mono-azo, bis-azo, triphenylmethane, triphenodioxazine, phthalocyanin, naptholactam, azine and anthraquinone. Most preferably mono-azo, bis-azo, azine and anthraquinone.

Most preferably the dye bears at least one sulfonate group.

Preferred shading dyes are selected from direct dyes, acid dyes, hydrophobic dyes, cationic dyes and reactive dyes.

If included, the shading dye is preferably present is present in the composition in range from 0.0001 to 0.01 wt %.

Enzymes

Enzymes can also be present in the formulation. Preferred enzymes include protease, lipase, pectate lyase, amylase, cutinase, cellulase, mannanase. If present the enzymes may be stabilized with a known enzyme stabilizer for example boric acid.

Anti-Redeposition Polymers

Anti-redeposition polymers are designed to suspend or disperse soil. Typically antiredeposition polymers are ethoxylated and or propoxylated polyethylene imine materials.

Dye Transfer Inhibitors

Modern detergent compositions typically employ polymers as so-called 'dye-transfer inhibitors'. These prevent migration of dyes, especially during long soak times. Generally, such dye-transfer inhibiting agents include polyvinyl pyrrolidone polymers, polyamine N-oxide polymers, copolymers of N-vinylpyrrolidone and N-vinylimidazole, manganese pthalocyanine, peroxidases, and mixtures thereof, and are usually present at a level of from 0.01 to 10 wt. % based on total amount in the laundry composition.

Soil Release Polymers

Soil release polymers are designed to modify the surface of the fabric to facilitate the easier removal of soil. Typically soil release polymers are based on or derivatives of polyethylene glycol/vinyl acetate copolymers or polyethylene glycol terephthalate polyesters.

Fluorescent Agent

The composition optionally comprises a fluorescent agent (optical brightener). Fluorescent agents are well known and many such fluorescent agents are available commercially. Usually, these fluorescent agents are supplied and used in the form of their alkali metal salts, for example, the sodium salts. The total amount of the fluorescent agent or agents used in the composition is generally from 0.005 to 2 wt. %, more preferably 0.01 to 0.1 wt. %.

The invention claimed is:

1. A fabric treatment composition comprising:

a) from 60 to 99 wt. % of polyethylene glycol;

b) from 0.1 to 5 wt. % of cationic polysaccharide polymer; and, c) from 0.1 to 10 wt. % of silicone;

wherein the polyethylene glycol has a molecular weight of from 2000 to 20,000;

wherein the silicone is an anionic or quaternary cationic silicone.

2. A composition as claimed in claim 1, wherein the polyethylene glycol is present at a level of from 62 to 98 wt. %.

3. A composition as claimed in claim 1, wherein the cationic polymer is present at a level of from 0.1 to 4 wt. %.

4. A composition as claimed in claim 1, wherein the cationic polysaccharide polymer is a cationic cellulose polymer or a cationic guar polymer.

5. A composition as claimed in claim 1, wherein the silicone is present at a level of from 0.25 to 8 wt. %.

6. A composition as claimed in claim 1 additionally comprising a secondary carrier other than polyethylene glycol at a level of from 5 to 45 wt. %.

7. A composition as claimed in claim 6, wherein the secondary carrier is starch.

8. A composition as claimed in claim 1 additionally comprising perfume at a level of from 1 to 15 wt. %.

9. A composition as claimed in claim 1, wherein the composition is in the form of a pastille.

10. A composition as claimed in claim 9, wherein the pastille has a shape that is circular, spherical, oval, or lozenge shape.

11. A composition as claimed in claim 9 wherein, each pastille has a mass of from 0.05 mg to 2 g.

12. A composition as claimed in claim 1 further comprising one or more of the following ingredients: shading dye, enzyme, antiredeposition polymer, dye transfer inhibiting polymer, soil release polymer, sequestrant, and/or fluorescent agent.

* * * * *